US009123983B1

(12) United States Patent
Oran

(10) Patent No.: US 9,123,983 B1
(45) Date of Patent: Sep. 1, 2015

(54) TUNABLE BANDPASS FILTER INTEGRATED CIRCUIT

(75) Inventor: Ekrem Oran, Nashua, NH (US)

(73) Assignee: Hittite Microwave Corporation, Chelmsford, MA (US)

( * ) Notice: Subject to any disclaimer, the term of this patent is extended or adjusted under 35 U.S.C. 154(b) by 328 days.

(21) Appl. No.: 13/553,952

(22) Filed: Jul. 20, 2012

(51) Int. Cl.
*H01P 1/205* (2006.01)
*H01P 1/208* (2006.01)
*H01P 1/219* (2006.01)

(52) U.S. Cl.
CPC ..... *H01P 1/205* (2013.01); *H01P 1/208* (2013.01); *H01P 1/219* (2013.01)

(58) Field of Classification Search
CPC ..... H01P 1/2002; H01P 1/207; H01P 1/208; H01P 1/2088; H01P 7/06; H01P 7/065; H01P 1/202
USPC ..... 333/208, 209, 212, 219, 235, 206, 207
See application file for complete search history.

(56) References Cited

U.S. PATENT DOCUMENTS

| | | | | |
|---|---|---|---|---|
| 2,487,619 | A | 11/1949 | Usselman | |
| 3,889,214 | A | 6/1975 | Petitjean et al. | |
| 4,835,499 | A | 5/1989 | Pickett | |
| 4,937,533 | A | 6/1990 | Livingston | |
| 5,382,931 | A | 1/1995 | Piloto et al. | |
| 5,821,836 | A | 10/1998 | Katehi et al. | |
| 5,908,811 | A | 6/1999 | Das | |
| 5,917,388 | A | 6/1999 | Tronche et al. | |
| 5,949,309 | A | 9/1999 | Correa | |
| 5,982,250 | A | 11/1999 | Hung et al. | |
| 6,018,282 | A | 1/2000 | Tsuda | |
| 6,137,383 | A | 10/2000 | DeLillo | |
| 6,160,463 | A | 12/2000 | Arakawa et al. | |
| 6,362,706 | B1 | 3/2002 | Song et al. | |
| 6,411,182 | B1 | 6/2002 | Song et al. | |
| 6,437,965 | B1 | 8/2002 | Adkins et al. | |
| 6,525,630 | B1 | 2/2003 | Zhu et al. | |
| 6,535,083 | B1 * | 3/2003 | Hageman et al. | 333/210 |
| 6,535,086 | B1 | 3/2003 | Liang et al. | |
| 6,771,147 | B2 | 8/2004 | Mongia | |
| 6,801,107 | B2 | 10/2004 | Chen et al. | |
| 6,924,718 | B2 | 8/2005 | Snyder | |
| 7,187,256 | B2 | 3/2007 | Oran | |
| 7,196,598 | B2 | 3/2007 | Maruhashi et al. | |
| 7,305,223 | B2 | 12/2007 | Liu et al. | |
| 7,548,136 | B1 | 6/2009 | Shah | |
| 7,570,137 | B2 | 8/2009 | Kintis et al. | |
| 7,755,445 | B2 * | 7/2010 | Dutta et al. | 333/1 |

(Continued)

OTHER PUBLICATIONS

Chandler, S.R. et al., "Active Varactor Tunable Bandpass Filter", IEEE Microwave and Guided Wave Letters, vol. 3, No. 3, Mar. 1, 1993, pp. 70-71.

(Continued)

*Primary Examiner* — Robert Pascal
*Assistant Examiner* — Gerald Stevens
(74) *Attorney, Agent, or Firm* — Knobbe, Martens, Olson & Bear, LLP

(57) ABSTRACT

A tunable bandpass filter integrated circuit includes a filter core including at least two spaced conductor layers, a plurality of peripherally spaced backside vias extending between the conductor layers defining a resonator cavity, at least one internal backside via, and a tunable impedance connected in series with the internal backside via between the conductor layers for adjusting the resonance of the cavity.

27 Claims, 17 Drawing Sheets

(56) References Cited

U.S. PATENT DOCUMENTS

| | | | | |
|---|---|---|---|---|
| 7,821,355 | B2 * | 10/2010 | Engel | 333/117 |
| 7,940,148 | B2 | 5/2011 | Knecht et al. | |
| 8,008,997 | B2 * | 8/2011 | Cho | 333/208 |
| 8,922,305 | B2 | 12/2014 | Oran | |
| 9,000,851 | B1 | 4/2015 | Oran | |
| 2003/0155865 | A1 * | 8/2003 | Ito et al. | 315/100 |
| 2006/0061438 | A1 * | 3/2006 | Toncich | 333/205 |
| 2008/0290465 | A1 | 11/2008 | de Vreede | |
| 2011/0227674 | A1 * | 9/2011 | Gevorgyan et al. | 333/239 |

OTHER PUBLICATIONS

Alter, David M., "Using PWM Output as a Digital-to-Analog Converter on a TMS320C240 DSP", Nov. 1998, Texas Instruments, 21 pages.

Kim et al., "Varactor-Tuned Combline Bandpass Filter Using Step-Impedance Microstrip Lines" IEEE Transaction on Microwave Theory and Techniques, vol. 52, No. 4, Apr. 1, 2004, pp. 1279-1283.

* cited by examiner

TUNABLE BANDPASS FILTER INTEGRATED CIRCUIT

FIELD OF THE INVENTION

This invention relates to a tunable bandpass filter integrated circuit, and more particularly to one which may be embodied in MMIC using a varactor or similar tuning device and which is operational at and above millimeter wavelength.

BACKGROUND OF THE INVENTION

Microstrip and stripline techniques are very popular at microwave frequencies due to their small physical size, versatility, price and ease of construction. However at millimeter wave frequencies and above, problems occur that limit the usability of such structures. The wavelengths become so small that parasitic effects brought by practical sized interconnections, such as input/output coupling and intra-layer transition vias are performance limiting, and unintended modes occur in the design. In order to reduce these effects one has to go to smaller and smaller layer thicknesses, which causes a reduction in the widths of the microstrips/striplines and exacerbating the natural metal losses of the resonators that increase with frequency. For these reasons microstrip/stripline based resonator structures can become too lossy for certain applications.

Mechanical filters offer distinct advantages at the above mentioned frequencies. The use of large metal surface resonators circumvents the electrical loss issue and coupling into and between resonators can be done through openings in the relatively large cavity resonators. However, these structures are large, hard to integrate with other components and extremely expensive Laminate based technology has been used in the past, see U.S. Pat. Nos. 6,535,083, 6,137,383 incorporated by reference herein. See also U.S. Pat. Nos. 5,821,836, 6,362,706, 6,535,083, and 5,382,931 which disclose constructing combline bandpass filter structures incorporated by reference herein. Walls formed by plated through holes or vias define dielectric filled waveguide structures. Furthermore, plated through holes that do not go all the way through and are situated inside the structures are used as the combline resonator elements. These prior art devices are fixed frequency filters and are not tunable unless separate non-integrated elements are added which negatively affect cost and performance. Integration of separate tuning elements is possible but limitations in miniaturization and parasitics will prevent high frequency operation.

An electrically tunable filter provides great flexibility in system architectures, by being able to replace multiple fixed frequency filters and switch matrices but this can result in interconnection parasitics between filter resonators and tunable elements at these frequencies.

SUMMARY OF THE INVENTION

It is therefore an object of this invention to provide an improved tunable bandpass filter integrated circuit.

It is a further object of this invention to provide such an improved tunable bandpass filter integrated circuit which is electrically tunable.

It is a further object of this invention to provide such an improved tunable bandpass filter integrated circuit which is implementable in fully integrated technology such a MMIC.

It is a further object of this invention to provide such an improved tunable bandpass filter integrated circuit which is applicable at and above mmW frequencies.

It is a further object of this invention to provide such an improved tunable bandpass filter integrated circuit which is relatively simple and inexpensive to implement.

The invention results from the realization that a tunable bandpass filter integrated circuit can be achieved using a filter core including at least two spaced conductor layers with a plurality of peripherally spaced backside vias extending between the conductor layers to define a resonator cavity, at least one internal via and a tunable impedance connected in series with the internal backside via between the conductor layers for adjusting the resonance of the cavity.

This invention features a tunable bandpass filter integrated circuit including a filter core which includes at least two spaced conductor layers, a plurality of peripherally spaced backside vias extending between the conductor layers defining a resonator cavity, at least one internal backside via, and a tunable impedance connected in series with the internal backside via between the conductor layers for adjusting the resonance of the cavity.

In a preferred embodiment the filter core may include a semiconductor material. The bandpass filter integrated circuit may be a microwave monolithic integrated circuit (MMIC). The bandpass filter integrated circuit may operate at and above millimeter wavelengths (mmW). The semiconductor material may include a low conductivity silicon. The semiconductor material may include gallium arsenide. The conductor planes may be on the top and bottom of the core. The tunable impedance may include a varactor. The tunable impedance may include a MEMS device. The tunable impedance may include a ferroelectric dielectric. At least one of the peripherally spaced backside vias may be omitted in at least two locations to form input and output ports. There may be two separated internal backside vias each establishing a resonator and each connected in series with a respective tunable impedance between the at least two conductor layers and a secondary metallization member extends between each of the tunable filters and one of the input and output ports. There may be a plurality of separated internal backside vias each establishing a resonator and each connected in series with a respective tunable impedance between the at least two conductor layers. Each pair of resonators may constitute a simple filter. The backside vias separating adjacent resonators may be omitted establishing an evanescent mode waveguide. There may be between adjacent resonators an opening in a conductor layer with a bridging secondary metallization element for coupling between those adjacent resonators. The extremities of the bridging secondary metallization element may be short circuited at the frequency of operation. There may be an inter-resonator tunable capacitance between resonators for controlling inter-resonator coupling. There may be coupling between non-adjacent resonators to establish asymmetrical bandpass response with one or more finite frequency nulls. The resonators may be in a line. The resonators may be in a folded path. The tunable impedance may include back-to-back connected varactors for mitigating large signal distortions. The back-to-back connected varactors may include a resistance for controlling the slope of amplitude equalization. The integrated circuit may include bump pads for flip chip mounting.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
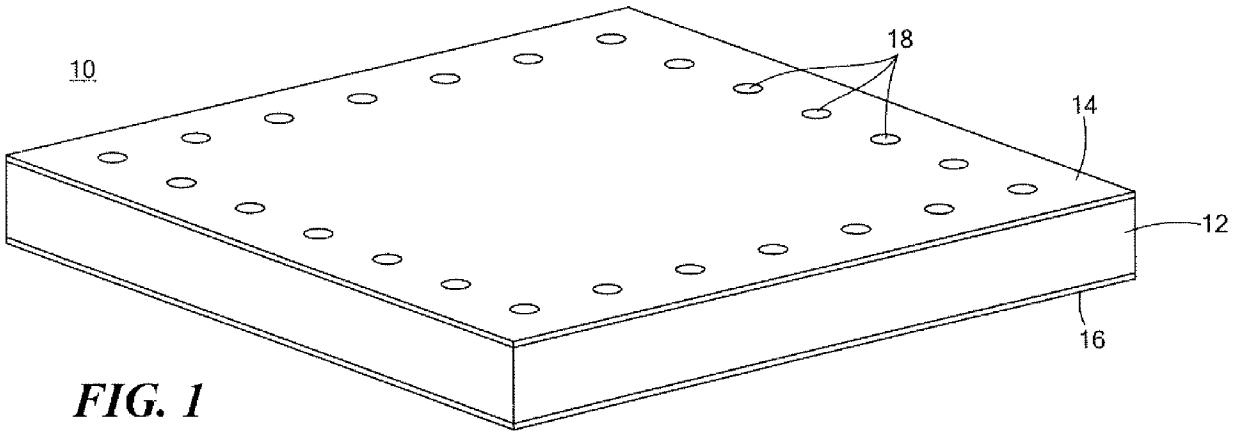
FIG. 1 is a three dimensional diagrammatic view of a cavity resonator with backside vias.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Figure 2:
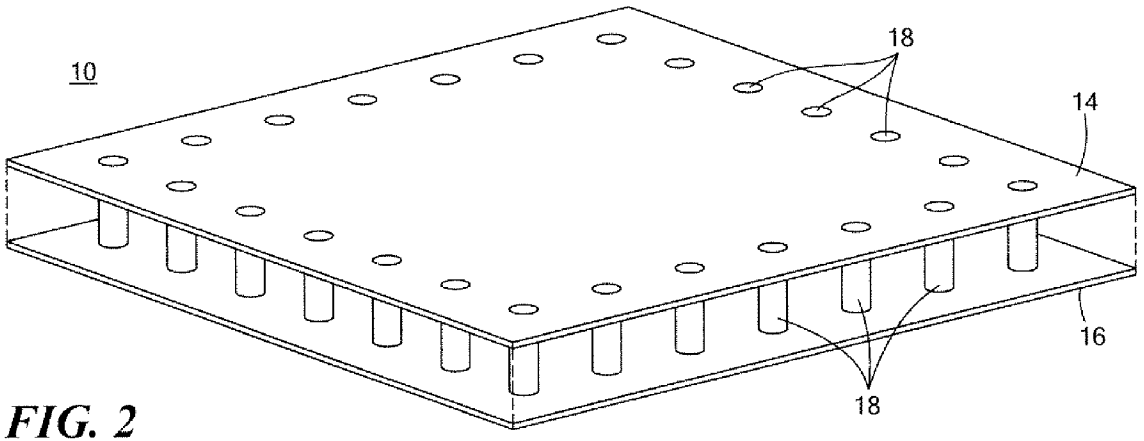
FIG. 2 is a view similar to FIG. 1 with filter core removed for clarity.

This invention in one embodiment provides a voltage control filter that incorporates structures to define by backside vias in microwave monolithic integrated circuits (MMIC). Bandpass filter responses at frequencies in the millimeter wavelength (mmW) range and higher can be obtained. Backside vias are used in MMIC's to create walls whereby electromagnetic energy can be confined to create electrical resonant cavities, see U.S. Provisional Patent Ser. No. 61/572,320 filed Jul. 14, 2011 incorporated by reference herein. Such a resonant cavity 10 is shown in FIG. 1, as including core 12 and two spaced conductor layers 14 and 16 electrically interconnected by backside vias 18. Core 10 is shown again in FIG. 2, with the core 12 removed for clarification.

Figure 3:
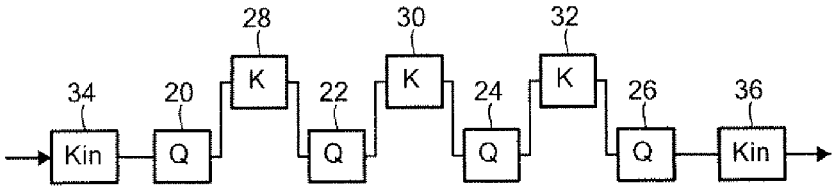
FIG. 3 is a schematic block diagram of a bandpass filter comprised of coupled resonators.
Figure 4:
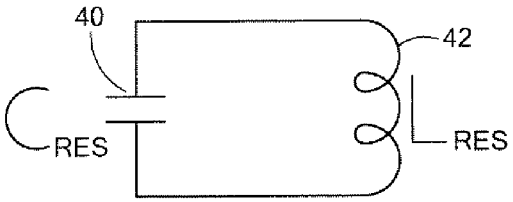
FIG. 4 is an LC equivalent circuit model of a cavity resonator.

At very high frequencies excessive filter loss is avoided and out of band suppression is increased by using a cascade of very high Q resonant cavities as shown in FIG. 3 where resonant cavities Q, 20, 22, 24 and 26 are coupled to each other by constant circuits K 28, 30 and 32 and the cavities at each edge are coupled externally with circuits Kin, 34 and 36. The size of the mmW frequency resonant cavity within an MMIC is on the order of several millimeters. A bandpass filter consisting of multiple resonant cavities fabricated with MMIC technology can be large and expensive. Additional elements can be inserted such that the resonant frequency can be altered, as described in see U.S. Provisional Patent Ser. No. 61/572,320 filed Jul. 14, 2011 incorporated by reference herein. These additional elements can be used reduce the size of the resonators such that the cavity resonator based bandpass filters become feasible within an MMIC. The "K" circuits represent the coupling between resonant cavities. The equivalent electrical circuit of the resonant cavity 20-26 is shown in FIG. 4 where capacitance 40, $C_{res}$ and inductance 42, $L_{res}$ represent the inductance capacitance of the cavity resonator.

Figure 5:
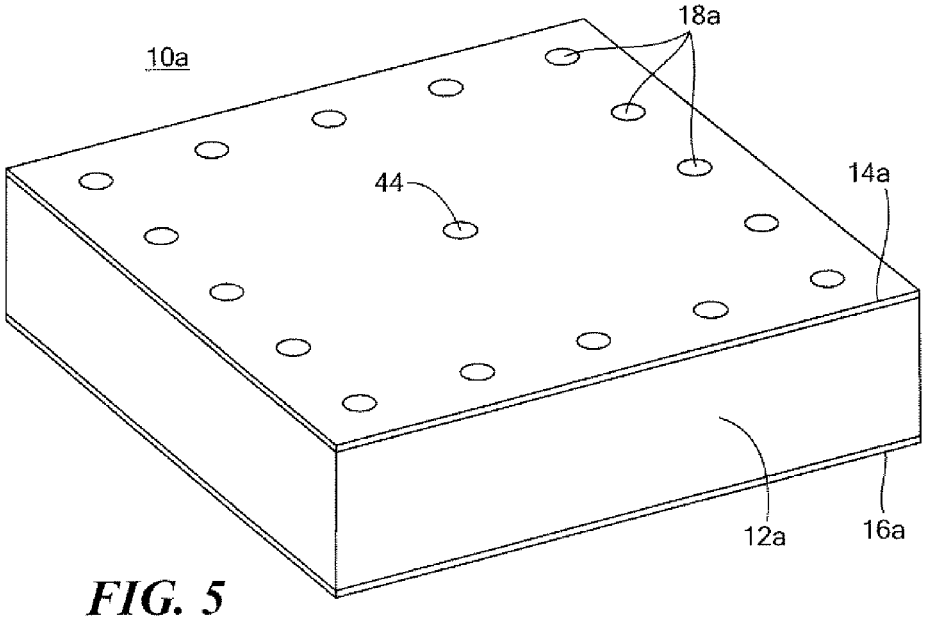
FIG. 5 is a view similar to FIG. 1, of a resonator with an internal backside via according to this invention.
Figure 6:
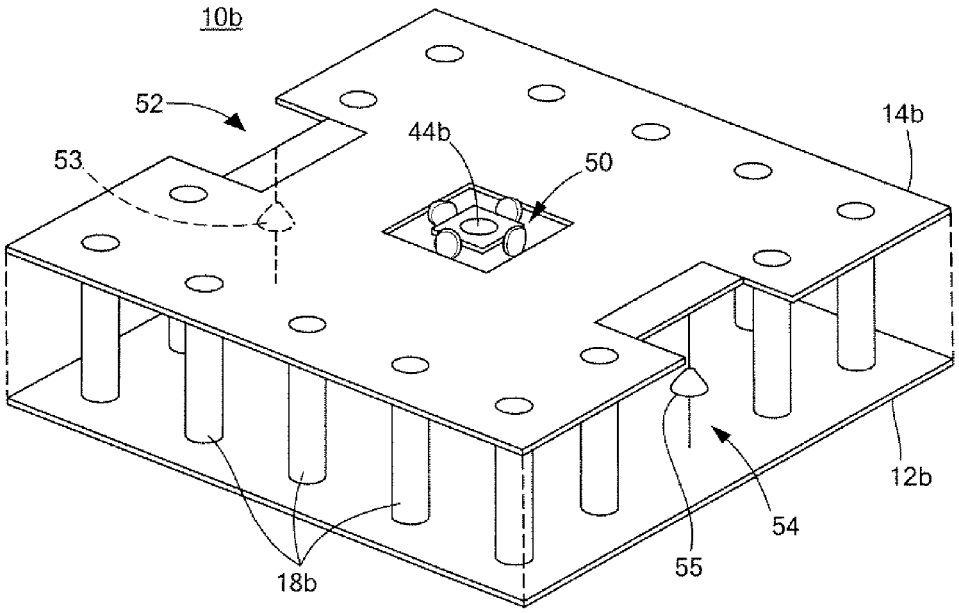
FIG. 6 is a view similar to FIG. 1 of a resonator with an internal via and capacitors with two ports.
Figure 7:
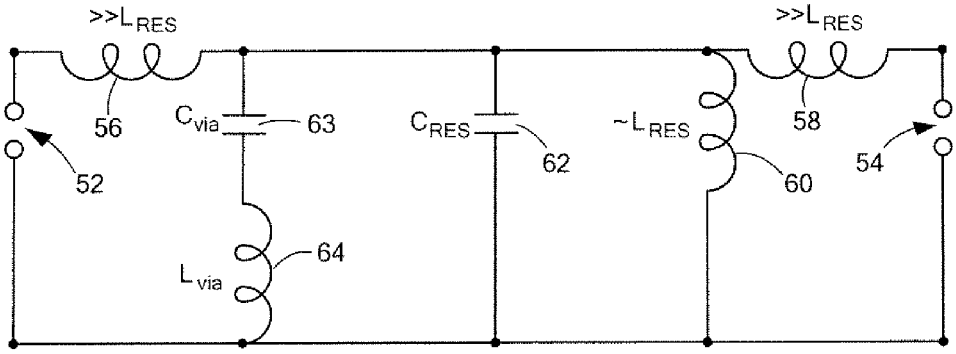
FIG. 7 is an equivalent circuit of the resonator of FIG. 6 in the nature of a two port comb resonator.

In contrast resonant cavity frequency can be increased by the addition of one or more backside vias such as internal via 44 in generally the middle region of the resonant cavity as shown in FIG. 5. In subsequent figures, like parts have been given like numbers and similar parts have been given like numbers accompanied by a lower case letter. Core 12*a* may be a semi-conductor material with dielectric properties such as gallium arsenide or silicon and may include other materials such as thin layers of dielectric as in FIG. 10B. Spaced conductor plates 14*a* and 16*a* are shown on the top and bottom surfaces of core 12*a* but this is not a necessary limitation. In other embodiments of the invention, in order to reduce the resonant frequency of the cavity 10*a*, the internal backside via or vias can have electrically capacitive tuning elements such as varactors, or MEMS, or ferroelectric dielectric materials 50, FIG. 6, attached to them at the point where they meet the top metallization or conductor 14*b* such as reverse biased collector-base diodes, micro electro mechanical plates and barium strontium titanate ferroelectric dielectric. In FIG. 6 at least one backside via has been removed at each end to create ports 52 and 54 where diodes 53 and 55 represent the impedance of the port. The equivalent circuit of such a two part comb resonator is shown in FIG. 7 where the inductive resonances 56 and 58 at ports 52 and 54, respectively, are much higher than the general inductance of the resonator $L_{RES}$ 60, the capacitance of the resonator $C_{RES}$ is represented at 62, the capacitance $C_{via}$ at 63 and inductance $L_{via}$ is shown at 64, respectively. Coupling into the bandpass filter can be done using any of the techniques shown in see U.S. Provisional Patent Ser. No. 61/572,320 filed Jul. 14, 2011 incorporated by reference herein.

Figure 8:
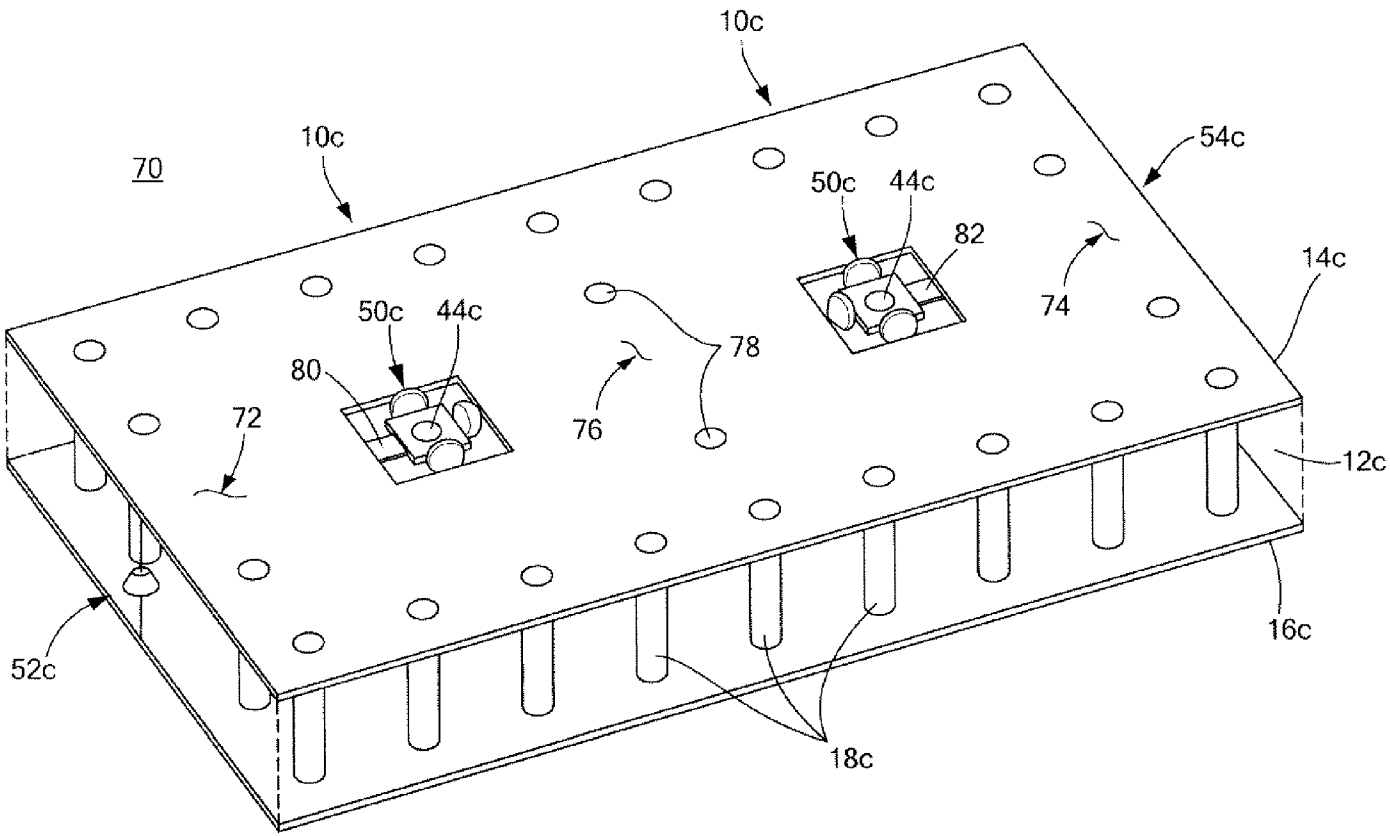
FIG. 8 is a view similar to FIG. 1 of a two cavity combline filter operating in a combline mode.
Figure 9:
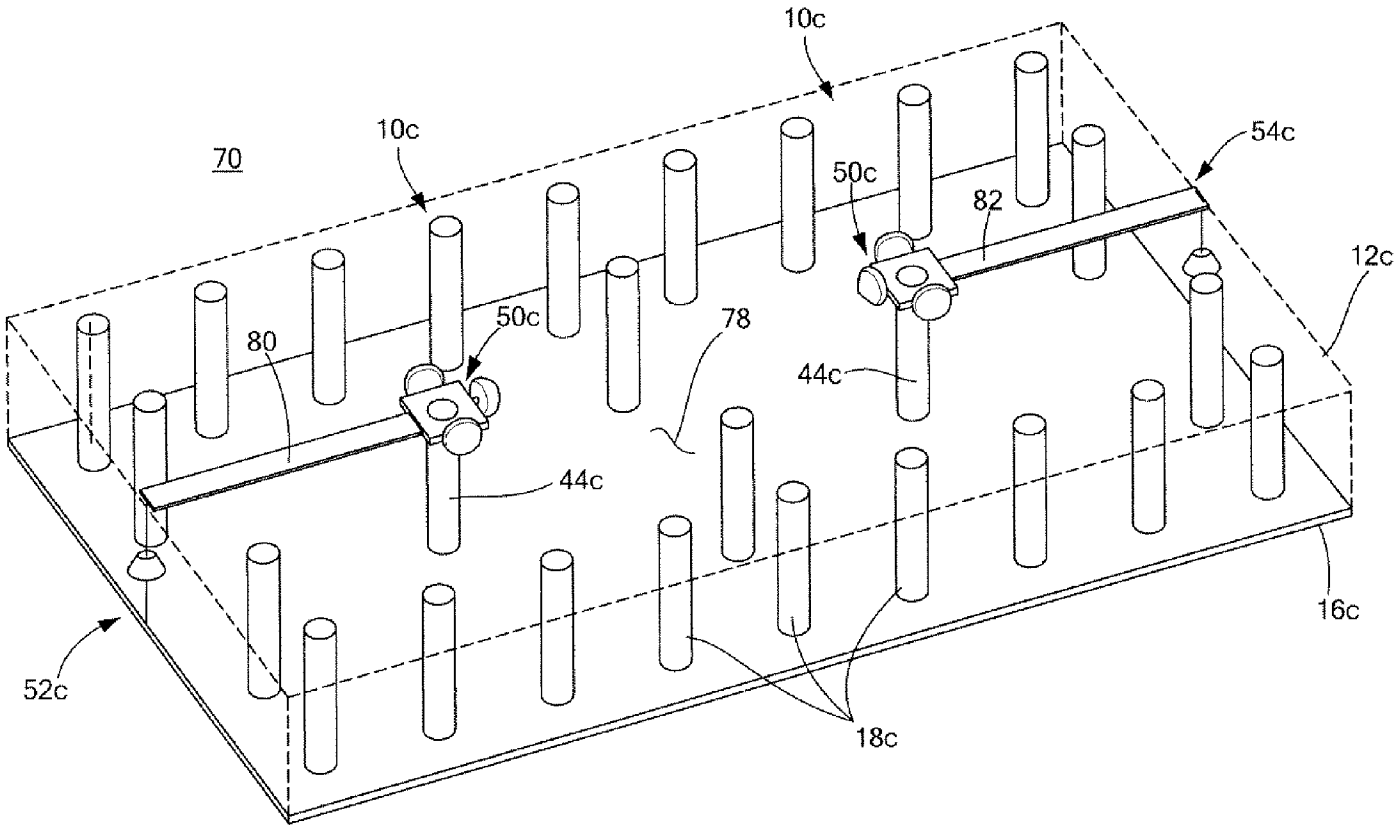
FIG. 9 is a view similar to FIG. 8 with the top conductor removed for clarity.

A combline filter 70, FIG. 8, operational in combline mode is shown with peripheral back side vias removed at areas 72 and 74 to create ports 52*c* and 54*c*, respectively and removed at area 76 to create an intermediate port 78. Combline filter 70 is shown with somewhat more clarity in FIG. 9, with the top conductor 14*c* removed. Stronger input coupling is provided in combline filter 70 by using secondary metallization 80 and 82 which runs underneath the top metallization layer or conductor 14*c* with the two forming electromagnetic transmission lines and connecting between each of the inner/central backside vias 44*c* and the variable capacitors 50*c* of the respective cavity resonators 10*e*. In FIG. 9 resonators 10*c* form a simple filter 70. The filter center frequency is adjusted by a backside via 44*c* located internally and preferably in the middle of each resonator, the variable capacitors and the cavity dimensions. The coupling between the two resonators in FIG. 9 is adjusted by the cavity dimensions, the distance between the two resonators and the opening of the backside via defined inner wall between resonators.

Figure 10A:
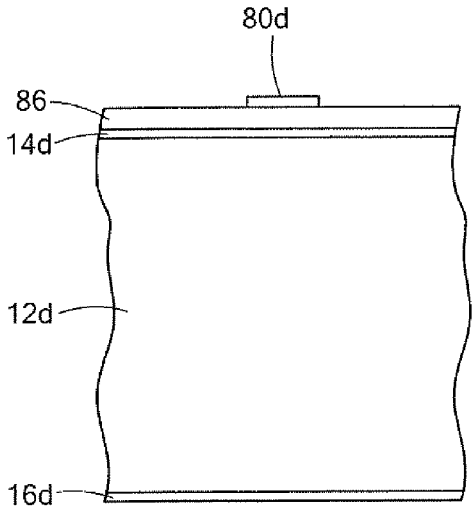
FIGS. 10A-D are schematic diagrams of four different examples of transmission lines using secondary metallization at the "top" conductor.
Figure 10B:
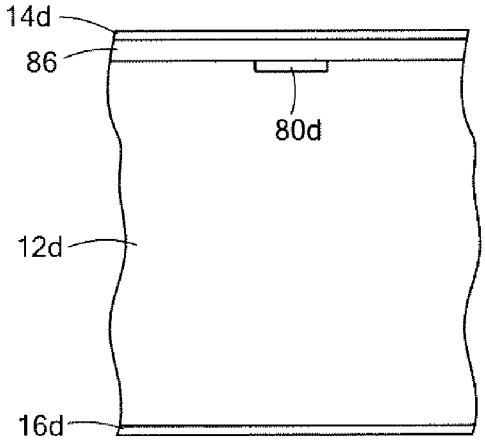
Figure 10C:
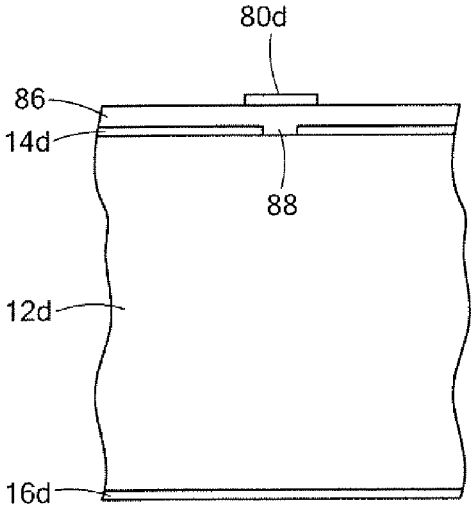
Figure 10D:
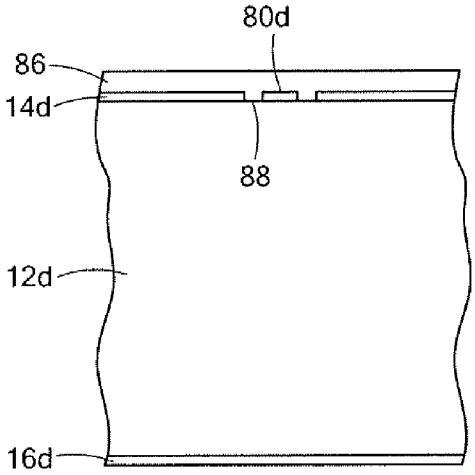

There are a number of different ways that transmission lines may use the secondary metallization with the top metal, for example. Four such ways are shown in FIGS. 10A, B, C, D. In FIG. 10A there is a dielectric 86 on top of the top metal 14*d* and the secondary metallization 80*d* is on top of the dielectric. In FIG. 10B the dielectric 86 is under the top metal 14*d* and forms a part of the cord 12*d*. The secondary metallization is under the dielectric. Dielectric 86 may include $SiO_2$, SiN or similar materials. In FIG. 10C the dielectric 86 is on top of the top metal 14*d* and the secondary metallization 80*d* is on top of the dielectric similar to FIG. 10A but there is a gap 88 in top metal 14*d* proximate secondary metallization 80*d*. In FIG. 10D there is also a gap in the top metal 14*d* but the secondary metallization 80*d* is disposed in gap 88 and spaced from the edges of dielectric 14*d* defined by gap 88.

Figure 11:
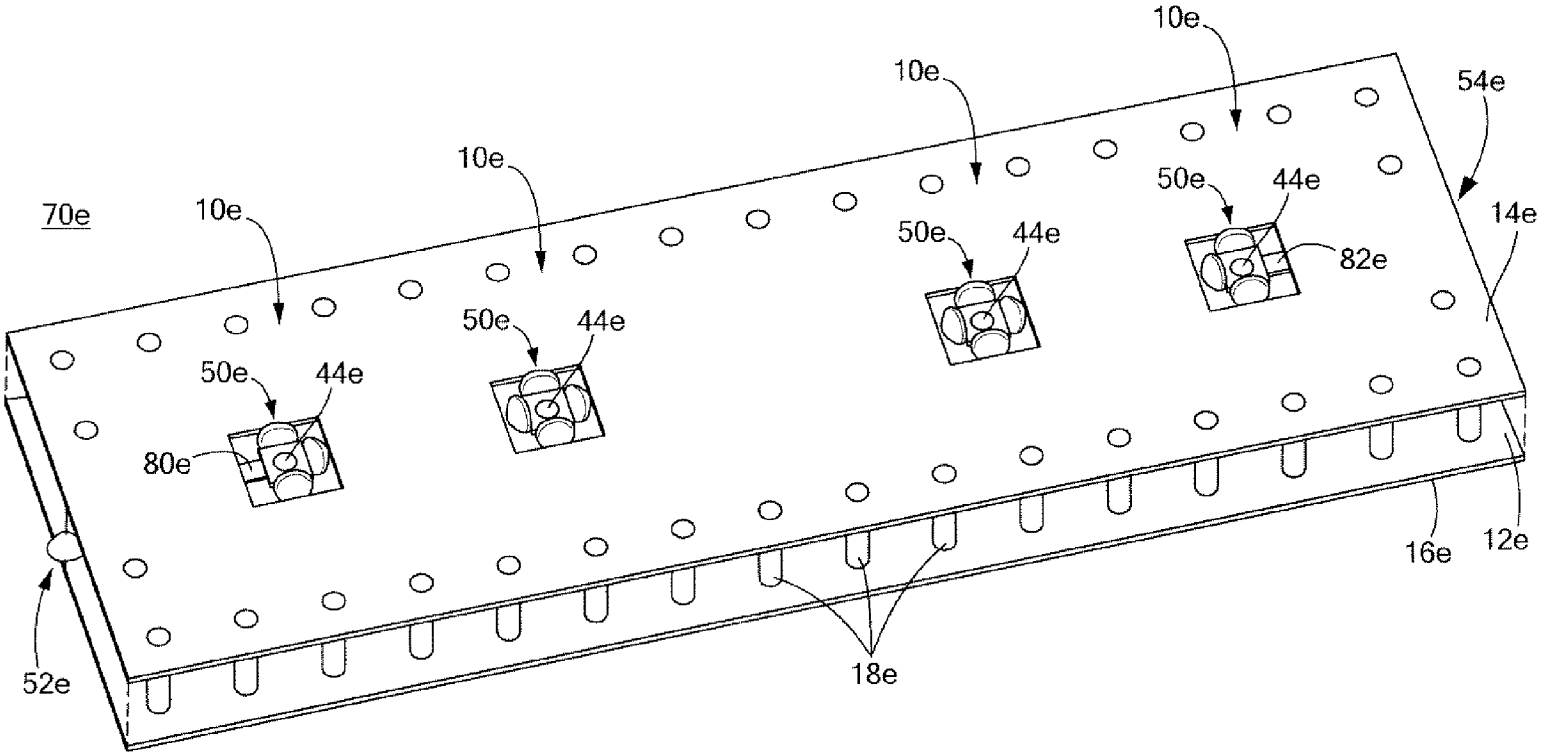
FIG. 11 is a view similar to FIG. 1 of a multiple combline resonator in an evanescent mode coupled filter.

In accordance with this invention a filter can be formed as with the single resonator 10*b* as shown in FIG. 6 or in another preferred embodiment it can be formed by multiple resonators coupled to each other as in FIG. 11 where there are four resonators 10*e*, which are essentially multiple combline resonators forming an evanescent mode coupled filter 70*e*. The coupling between resonators 10*e* can be adjusted by the opening left by the omitted backside vias in the areas separating the adjacent resonators 10*e*. When all of the backside vias between cavities are removed as in FIG. 11 an evanescent mode waveguide structure is obtained. FIG. 11 is, in fact, a realistic implementation of the block diagram of FIG. 3. Secondary metallization 80*e* and 82*e* in FIG. 11 that is just beneath the top metallization is connected to the first and last resonators 10*e* to couple in and out of filter 70*e*. Inter-resonator coupling can also be adjusted using secondary metallization situated beneath or above the top surface as indicated previously.

Figure 12:
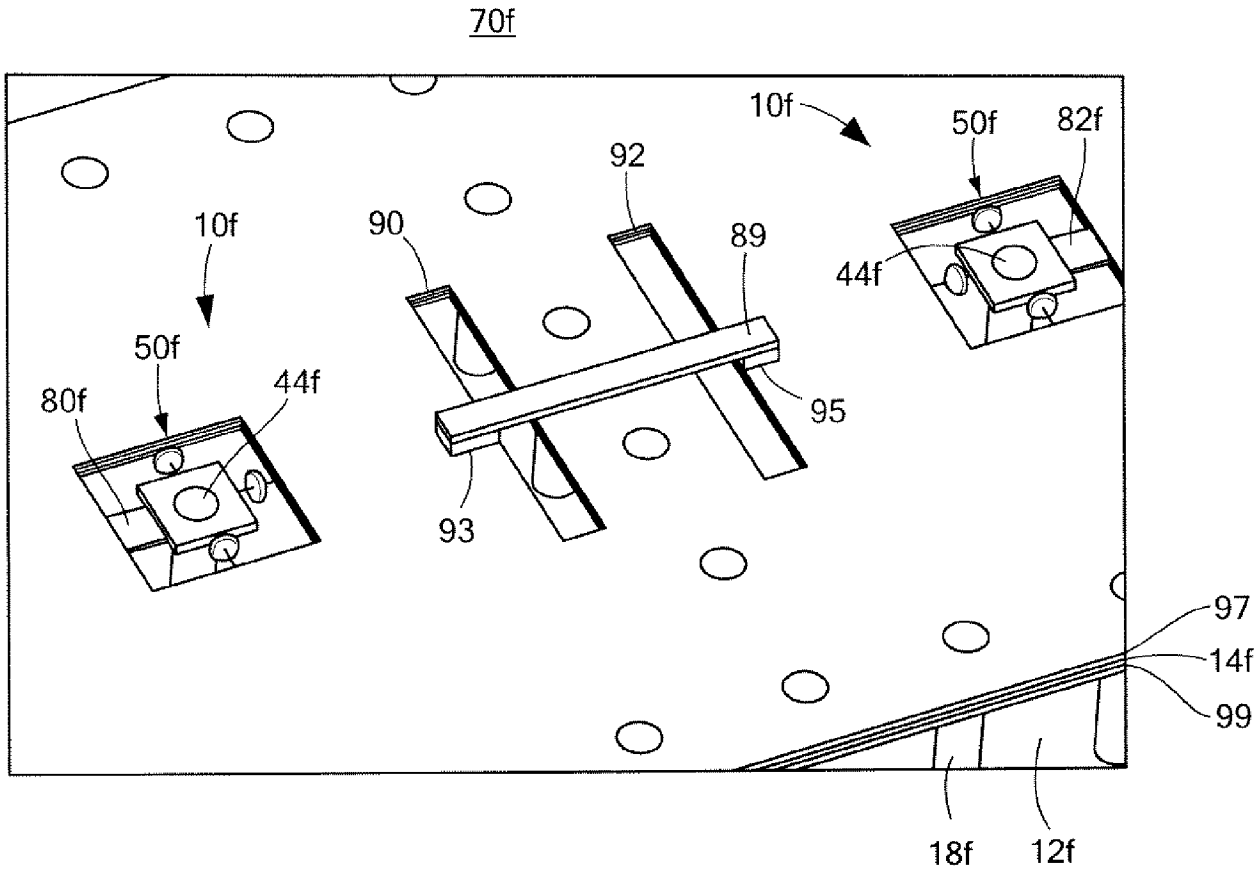
FIG. 12 shows a portion of multiple combline resonator similar to that of FIG. 11 with coupling through secondary metallization.

FIG. 12 illustrates inter-resonator coupling using secondary metallization 89 situated above the top metal 14*f* of the cavity 10*f*. Here slots 90, 92 are used to couple energy into transmission line 89 and then back into the next resonator. The secondary metal 89 in this example could just as well have been below top metal 14*f*. The extremities of line 89 can be terminated in a number of ways and for greater coupling they can be effectively short circuited at the frequency of operation such as by shorting blocks 93, 95 which extend through insulating layer 97 to conductor layer 14*f*. That short circuit can be a quarter wavelength extension, a large valued capacitor or a physical short as shown in FIG. 12. Since backside via placement tolerances can be relatively high, this technique is beneficial when low levels of coupling between resonators need to be well controlled. Although there may be various layers associated with conductor layers 14 and 16 and core 12, they have been omitted for clarity generally in the figures except where needed for understanding.

Figure 13:
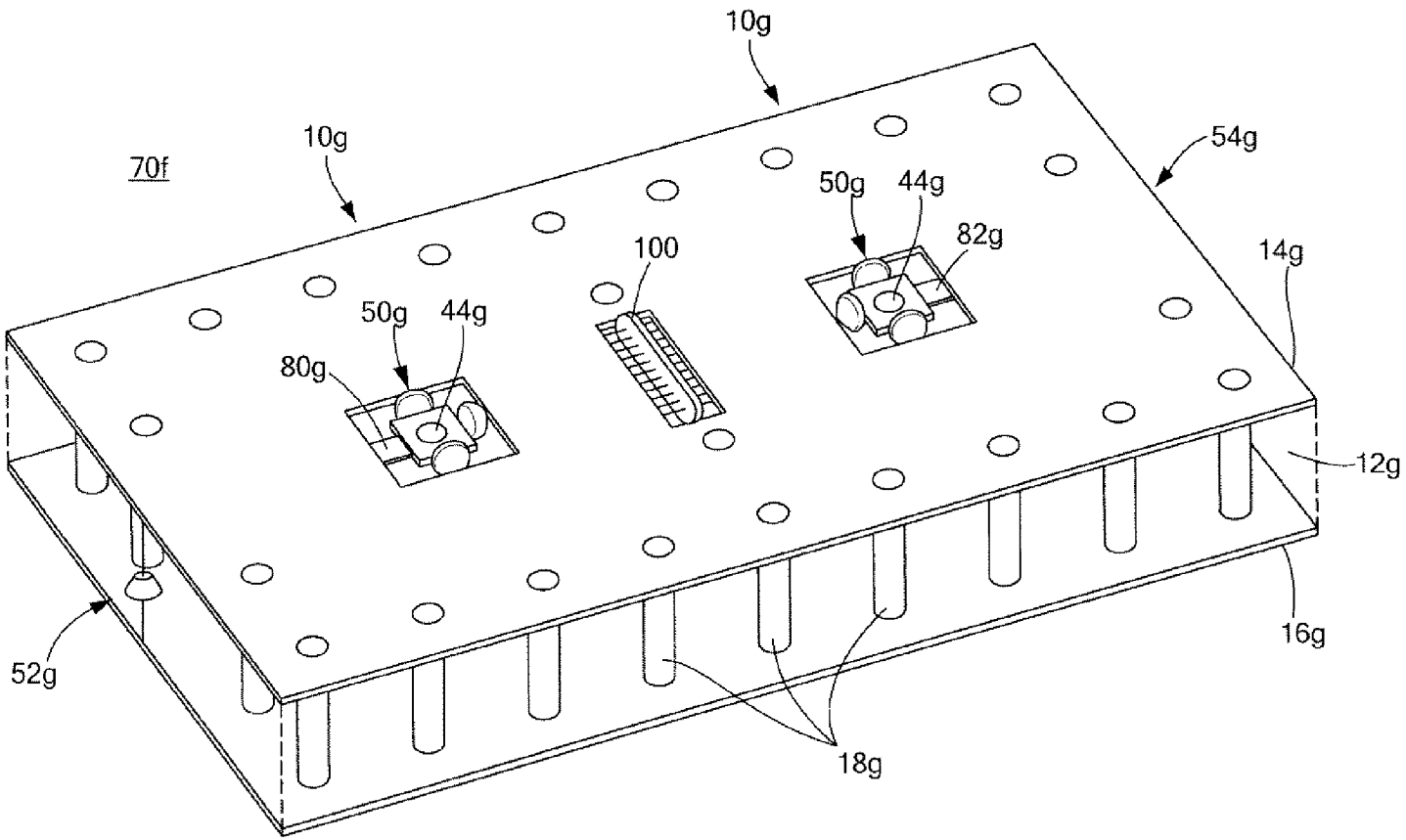
FIG. 13 is a view similar to FIG. 12 where the coupling includes a variable capacitance device.

The level of inter-resonator coupling can be electrically adjusted by inserting tunable capacitors 100, FIG. 13, in the top metallization 14*g*, FIG. 13, or inserted in the path of the secondary metallization line 89 of FIG. 12, for example. That secondary line 89 of FIG. 12 can be modified in a number of ways in order to vary the coupling amplitude and phase versus frequency characteristics.

Figure 14:
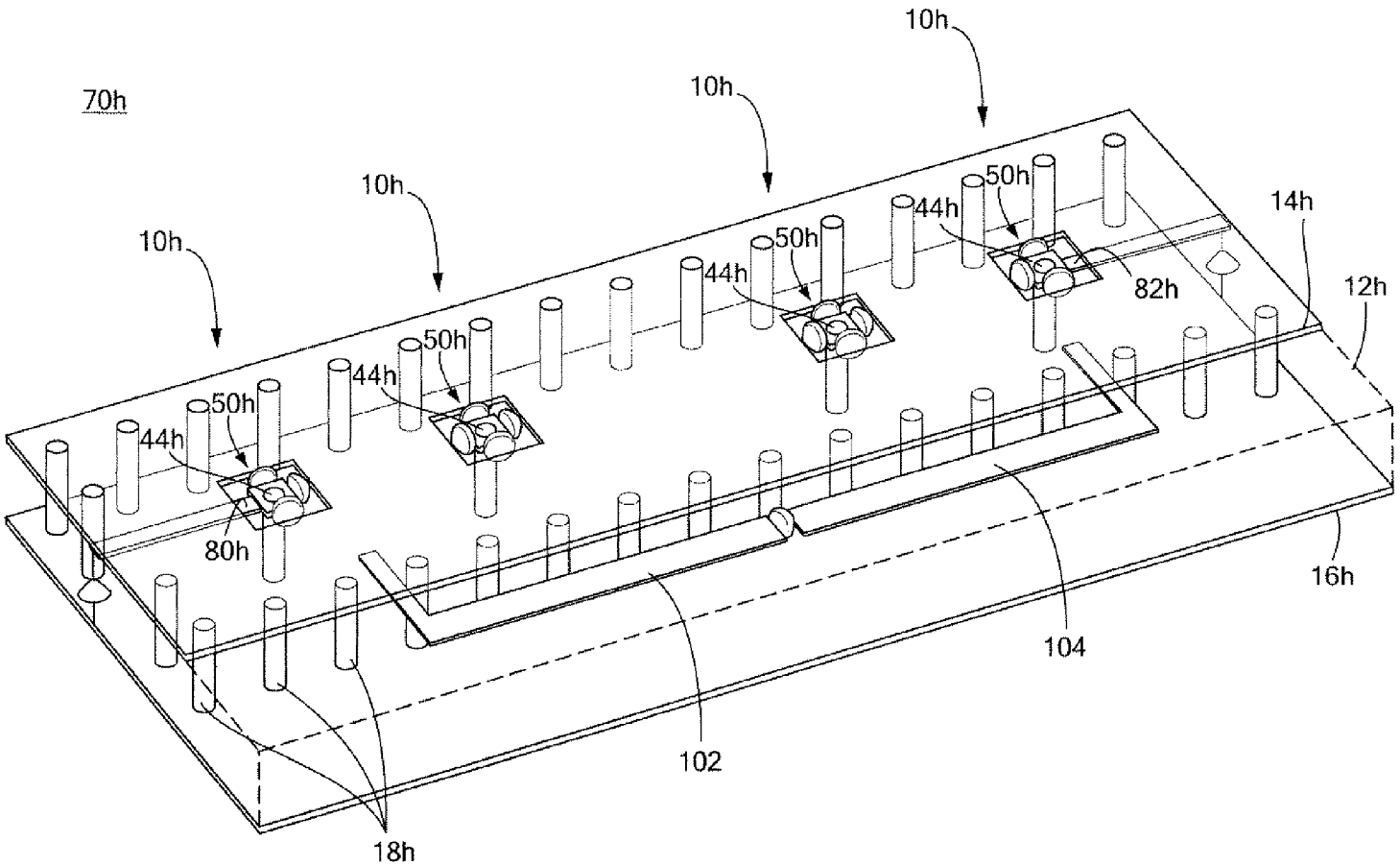
FIG. 14 is a view similar to FIG. 1 of a multiple combline resonator with non-adjacent coupling with the top conductor mode transparent for clarity.
Figure 15:
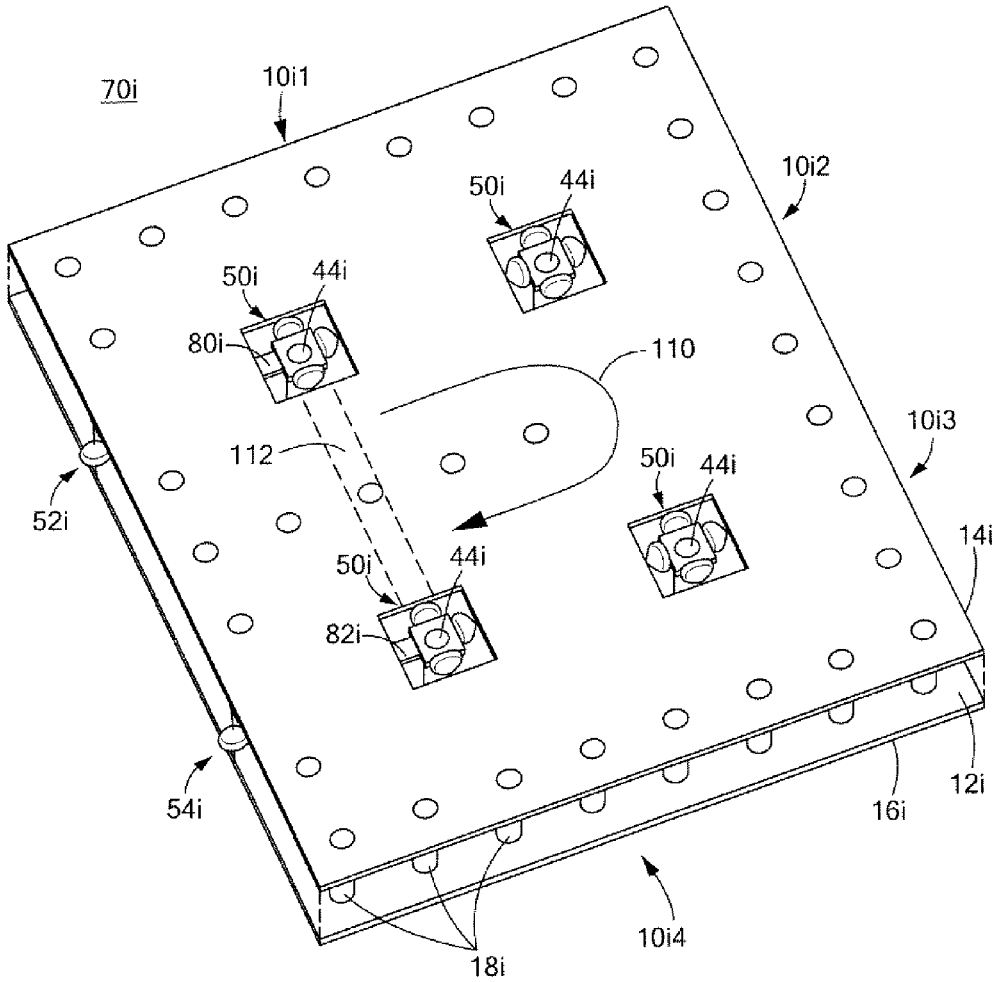
FIG. 15 is a view similar to FIG. 14 but with the structure folded.
Figure 16:
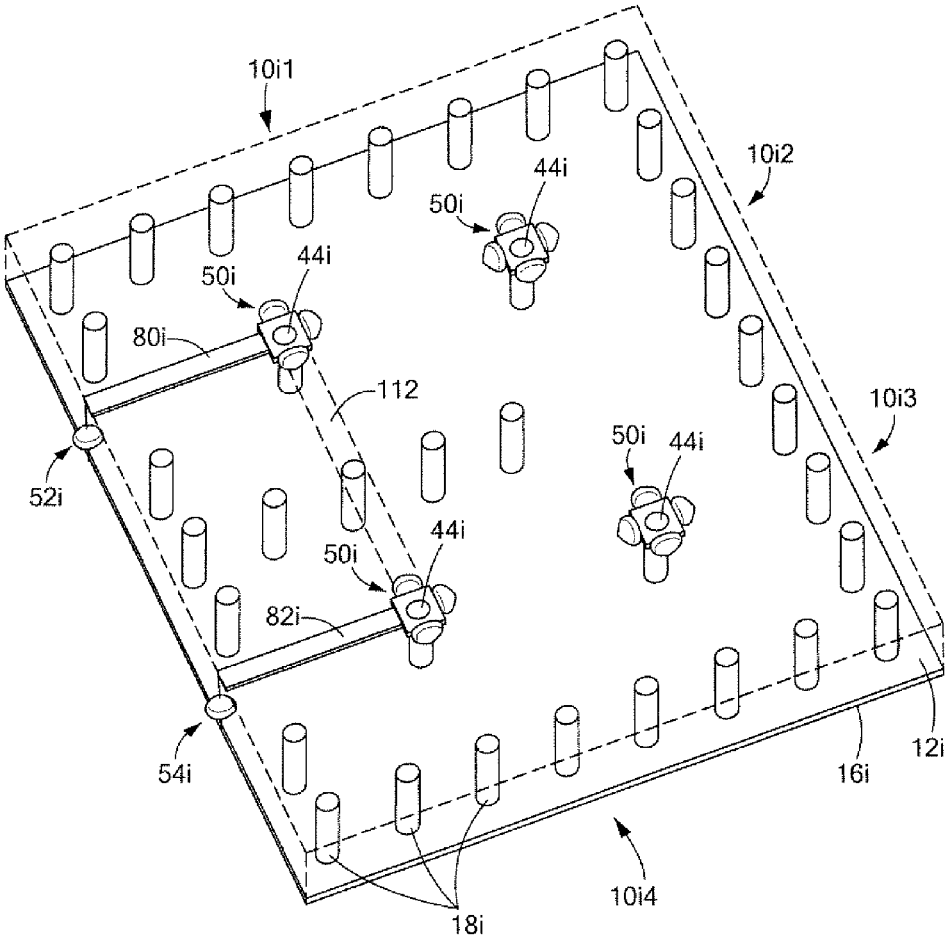
FIG. 16 is a view of FIG. 15 with the top conductor removed for clarity.
Figure 17:
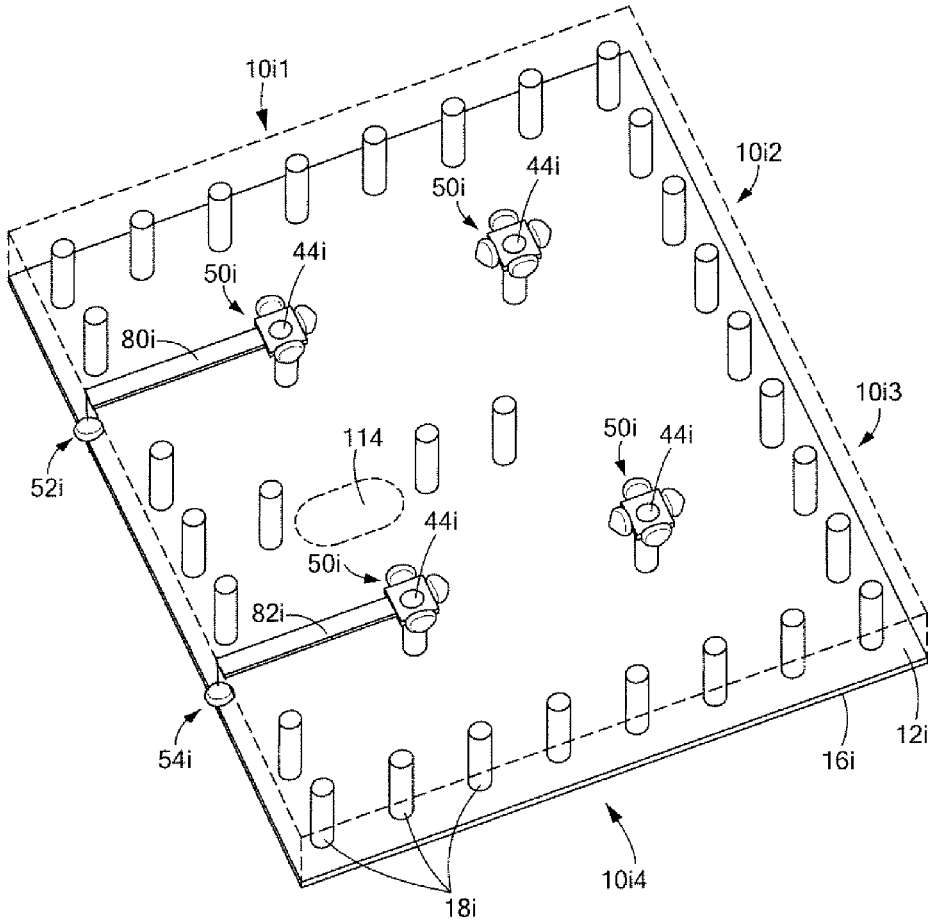
FIG. 17 is a view similar to FIG. 16 with non-adjacent coupling between first and last resonators yielding asymmetrical electrical bandpass response.

When resonators are strictly coupled only to adjacent resonators input to output electrical response will have a bandpass characteristic, but it will not have a transmission zero at finite frequency. The rejection of the filter will increase as the frequency tends to infinity and to zero. However when signals are coupled from one resonator 10*h* to another, FIG. 14 at specific magnitude and phase into non-adjacent resonators asymmetrical bandpass responses are obtained where finite frequency nulls are present. The non-adjacent coupling can be accomplished by additional secondary metallization members 102 and 104, for example, in FIG. 14. Thus the energy can be picked up from one resonator and routed through the walls formed by the backside vias 18 and then delivered to any of the other resonator in the filter. In FIG. 14 the signal is picked up from the first resonator 10*h*, delivered through secondary metallization 102 and 104 and into the last resonator 10*h*. FIGS. 15 and 16 illustrate another implementation where the cavities 10*i*1-10*i*4 are not in a straight line but are folded as indicated by arrow direction line 110 so that filter 70*i* becomes more compact and the input/output sections 52*i*, 54*i* are next to each other. In this structure an asymmetrical bandpass response can easily be created since resonant structures 10*i*1 and 10*i*4 are side by side and the required low level coupling is easily delivered through secondary metallization such as line 112. In FIG. 17 a backside via has been removed to create the coupling between non-adjacent resonant cavities in the filter by the removal of one or more backside vias in the area indicated at 114.

Figure 18:
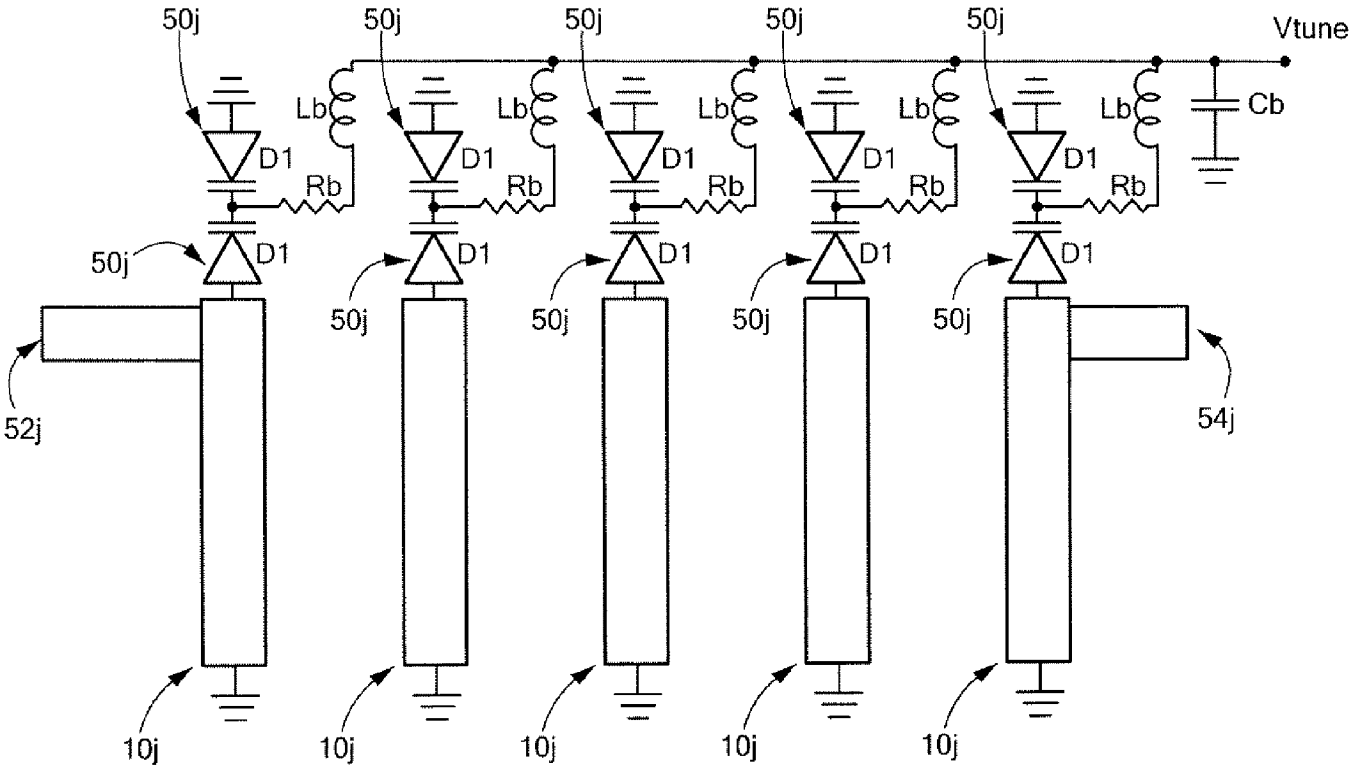
FIG. 18 is an equivalent circuit of a five resonator coupled filter.
Figure 19:
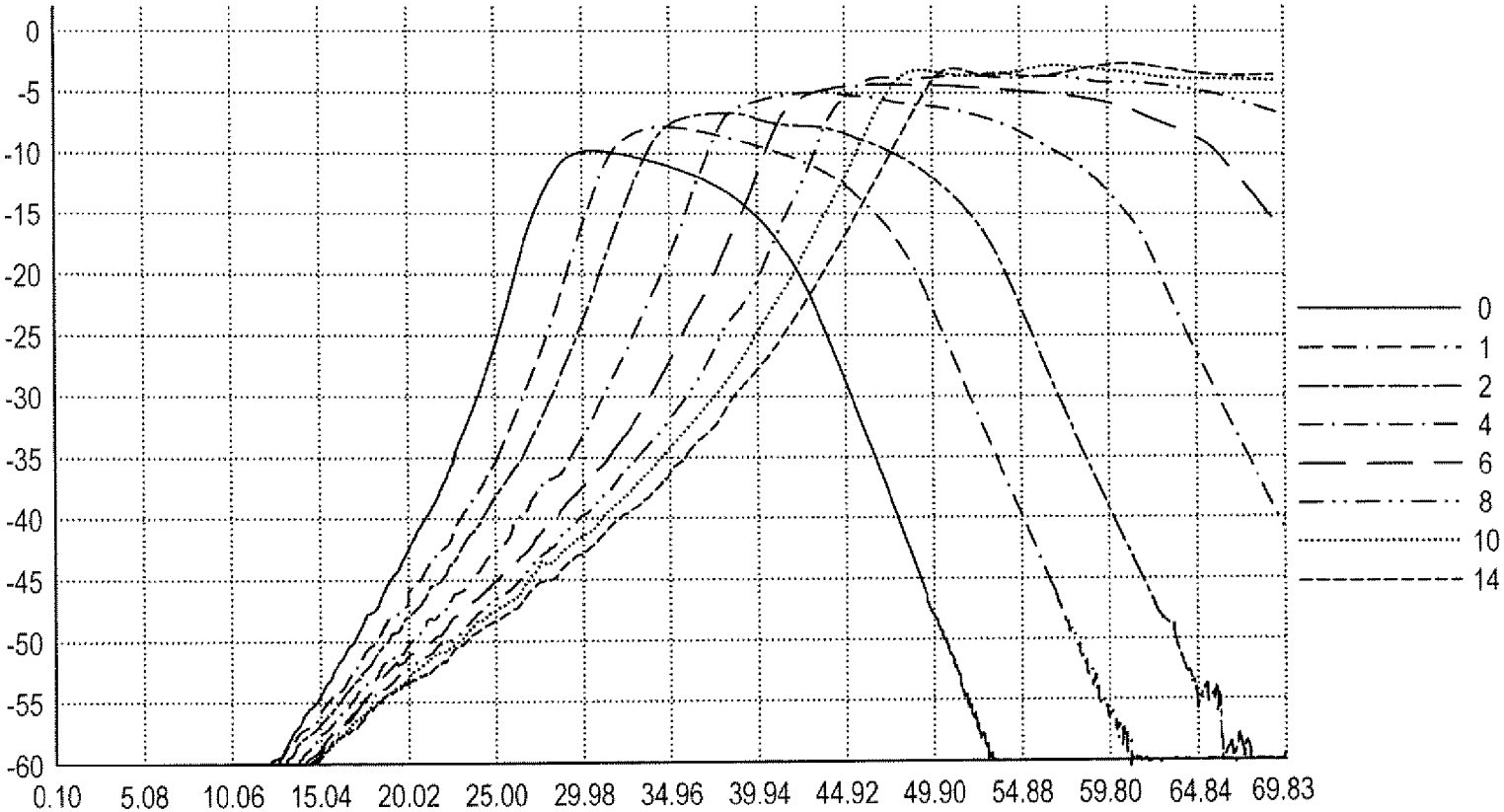
FIG. 19 is a representation of the transfer function of the filter of FIG. 18.
Figure 20:
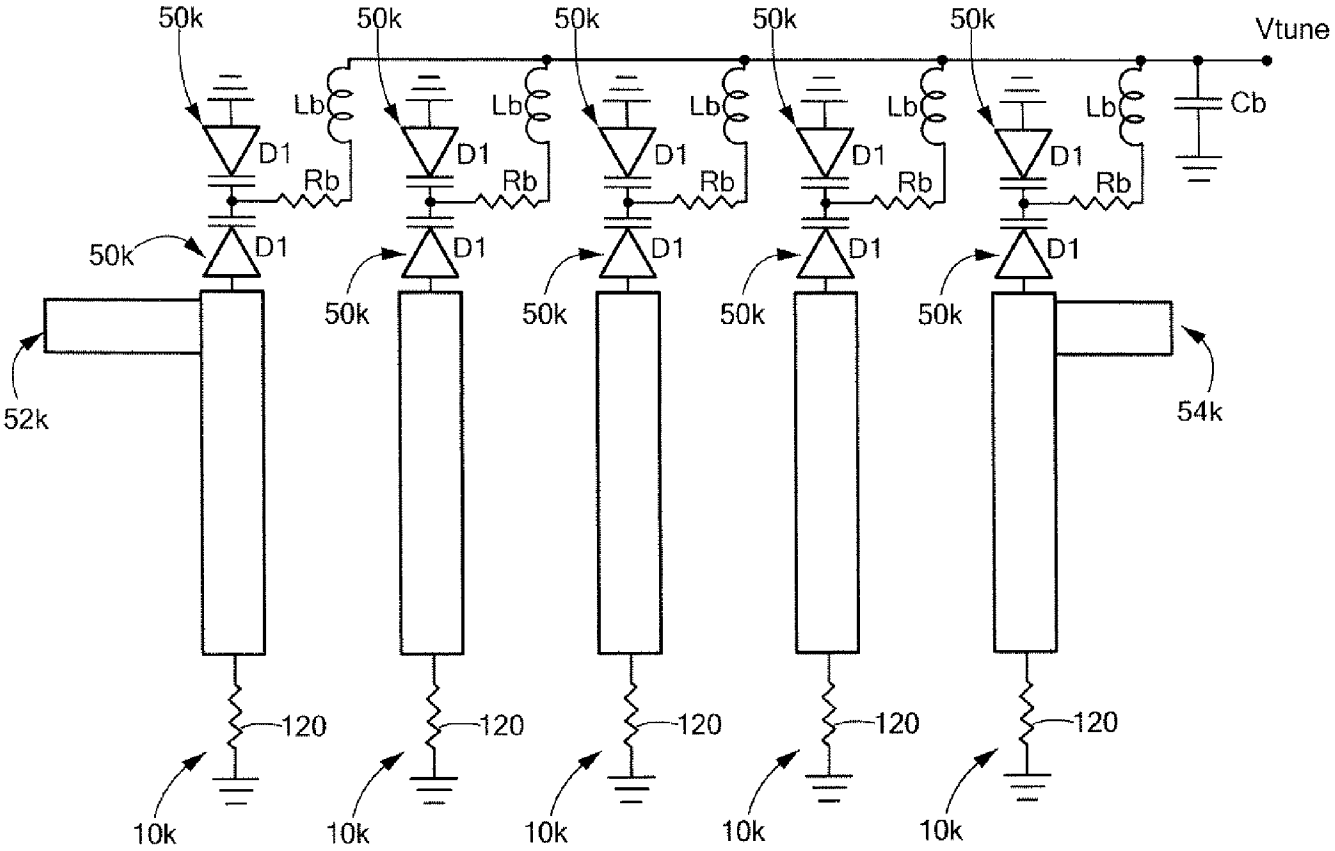
FIG. 20 is a view similar to FIG. 18 with additional equalization resistances.
Figure 21:
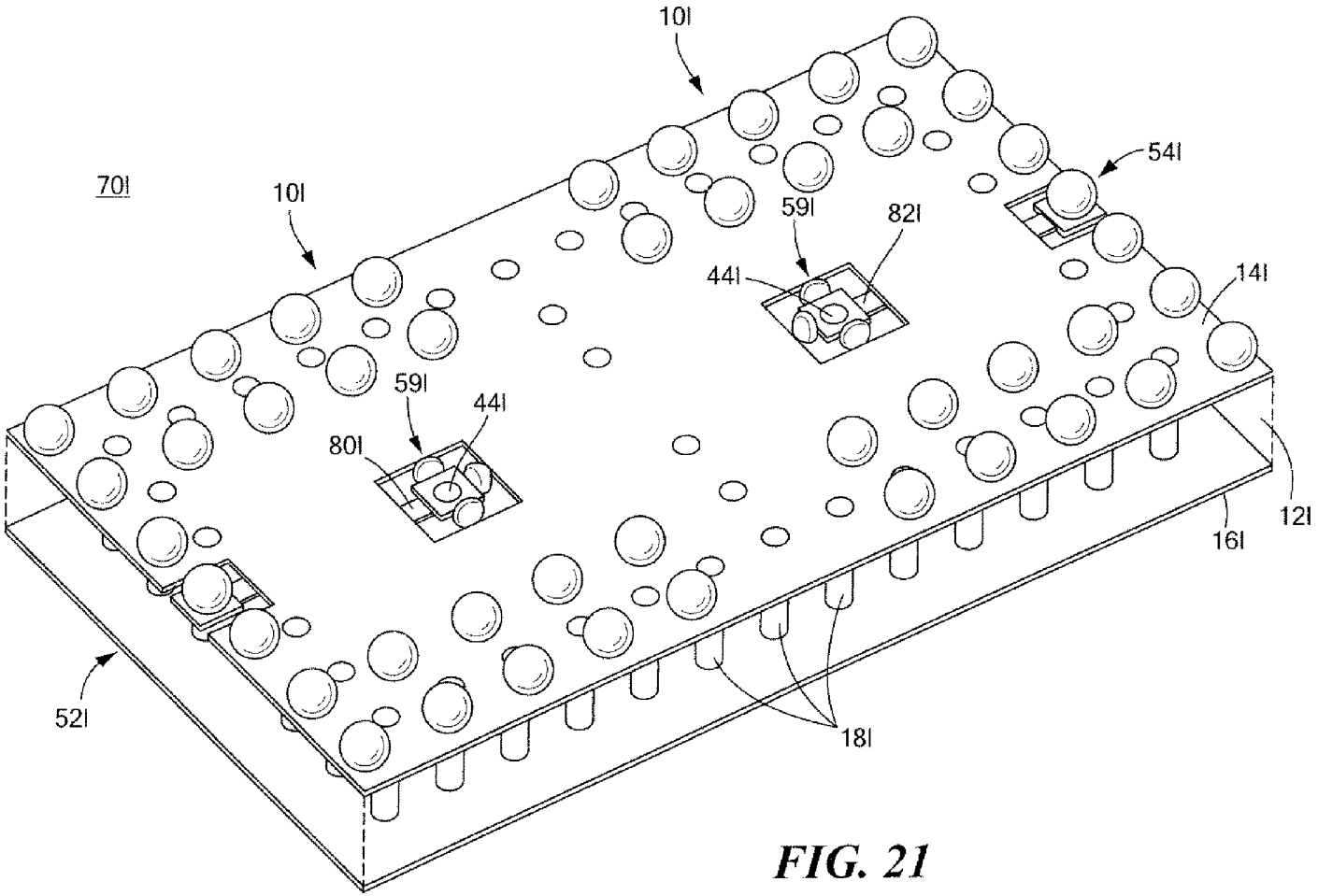
FIG. 21 illustrates the use with resonator filters of bonding bumps for flip-chip bonding.

The distortion created when large signal levels are applied is improved by incorporating back to back (cathode to cathode or anode to anode) pairs of varactors for each single varactor in the filter substantially eliminating the non-symmetrical variation of capacitance under ac excitation around a given de operating point. Back to back pairs of varactors also facilitate the dc biasing since either side of the varactors do not need to be dc blocked. Such an embodiment of a bandpass filter is shown in FIG. 18 including five coupled resonators 10*j*, each of which has associated with it a pair of back to back varactors 50*j*; this structure will cover more than 35 GHz to 70 GHz and typically has a 40 dB suppression at sub-harmonic frequencies, better than a 10 dB return loss, and insertion loss that has an amplitude equalization feature as shown in FIG. 19. That amplitude equalization feature is demonstrated in FIG. 19 where y-axis represents insertion loss in dB, and the x-axis is the transfer function in pure numbers. Curves "0" to "14" represent the actual tuning voltage value in volts. As the tuning voltage is modified from 0 to 14 volts the center frequency of the response moves from around 32 GHz to somewhere around 65 GHz. From the y-axis one can tell that the insertion loss value changes from "high" loss (i.e. around 10 dB) to "low" loss (i.e. around 4 dB) as the frequency increases. This is the amplitude equalization feature. Equalization effect is due to the low reactance value of the resonators preferred for wide tuning bandwidth and the relatively high resistive components in the circuit such as the resistance of the varactors. As the filter is tuned higher in frequency, the reactance of the resonators increases while the overall resistance of the components stays relatively constant or decreases, the insertion loss of the circuit improves and amplitude equalization is achieved. Further control of the amplitude equalization slope can be achieved by introduction of additional resistance on the coupled lines as shown in FIG. 20 where the additional resistances 120 are interconnected between each resonator cavity and ground. Bumping of pads and grounds, including control lines, by the use of bumps 130, FIG. 21, is implementable for flip chip mounting of the devices. The fully integrated nature and the availability of solid ground almost everywhere in the MMIC bandpass filter construction allows for the best of band rejection and ultimate in high frequency transition performance.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. A tunable bandpass filter integrated circuit comprising:

at least two spaced conductor layers;

a plurality of peripherally spaced backside vias extending between said two spaced conductor layers defining a resonator cavity;

at least one internal backside via comprising a first internal backside via; and a tunable impedance connected in series with said first internal backside via between said two spaced conductor layers, wherein a center frequency of the tunable bandpass filter is based at least partly on an impedance of said first internal backside via and an impedance of the tunable impedance, and wherein adjusting the impedance of the tunable impedance causes the center frequency of the tunable bandpass filter to be adjusted.

2. The tunable bandpass filter integrated circuit of claim 1 in which said bandpass filter integrated circuit is a microwave monolithic integrated circuit (MMIC).

3. The tunable bandpass filter integrated circuit of claim 1 in which said bandpass filter integrated circuit operates at and above millimeter wavelengths (mmW).

4. The tunable bandpass filter integrated circuit of claim 1 in which a semiconductor material is disposed between the two spaced conductor layers.

5. The tunable bandpass filter integrated circuit of claim 4 in which said semiconductor material includes a low conductivity silicon.

6. The tunable bandpass filter integrated circuit of claim 4 in which said semiconductor material includes gallium arsenide.

7. The tunable bandpass filter integrated circuit of claim 4 in which a dielectric layer is disposed between said two spaced conductor layers.

8. The tunable bandpass filter integrated circuit of claim 7 in which said dielectric layer includes SiN.

9. The tunable bandpass filter integrated circuit of claim 7 in which said dielectric layer includes $SiO_2$.

10. The tunable bandpass filter integrated circuit of claim 1 in which said two spaced conductor layers are disposed on a top and a bottom of a filter core.

11. The tunable bandpass filter integrated circuit of claim 1 in which said tunable impedance includes a varactor.

12. The tunable bandpass filter integrated circuit of claim 1 in which said tunable impedance includes a MEMS device.

13. The tunable bandpass filter integrated circuit of claim 1 in which said tunable impedance includes a ferroelectric dielectric.

14. The tunable bandpass filter integrated circuit of claim 1 in which at least one of said peripherally spaced backside vias is omitted in at least two locations to form input and output ports.

15. The tunable bandpass filter integrated circuit of claim 14 further comprising a second tunable impedance element, wherein said at least one internal backside via comprises a second internal backside via, wherein said second internal backside via and the second tunable impedance are disposed in series between said two spaced conductor layers, said second internal backside via being separated from said first internal backside via, wherein a secondary metallization member extends between one of said input and output ports and at least one of said tunable impedance and said first internal backside via.

16. The tunable bandpass filter integrated circuit of claim 1 further comprising a second tunable impedance, wherein said at least one internal backside via comprises a second internal backside via, wherein said first internal backside via is separated from said second internal backside via, and wherein said second internal backside via and the second tunable impedance are connected in series between said two spaced conductor layers, wherein said first internal backside via and said tunable impedance are included in a first resonator, and wherein said second internal backside via and the second tunable impedance are included in a second resonator.

17. The tunable bandpass filter integrated circuit of claim 16 in which the first resonator and the second resonator each function as a filter.

18. The tunable bandpass filter integrated circuit of claim 16 in which the bandpass filter is configured as an evanescent mode filter.

19. The tunable bandpass filter integrated circuit of claim 16 in which there is an opening in a conductor layer of said two spaced conductor layers with a bridging secondary metallization element for coupling between the first resonator and the second resonator.

20. The tunable bandpass filter integrated circuit of claim 19 in which extremities of the bridging secondary metallization element are short circuited at a frequency of operation.

21. The tunable bandpass filter integrated circuit of claim 16 in which there is an inter-resonator tunable capacitance between the first and second resonators for controlling inter-resonator coupling.

22. The tunable bandpass filter integrated circuit of claim 16 in which there is coupling between the first resonator and a non-adjacent resonator to establish asymmetrical bandpass response with one or more finite frequency nulls.

23. The tunable bandpass filter integrated circuit of claim 16 in which the first and second resonators are in a line.

24. The tunable bandpass filter integrated circuit of claim 16 in which the first and second resonators are in a folded path.

25. The tunable bandpass filter integrated circuit of claim 1 in which said tunable impedance includes back-to-back connected varactors for mitigating large signal distortions.

26. The tunable bandpass filter integrated circuit of claim 25 in which said back-to-back connected varactors include a resistance for controlling the slope of amplitude equalization associated with the bandpass filter integrated circuit.

27. The tunable bandpass filter integrated circuit of claim 1 in which said integrated circuit includes bump pads for flip chip mounting.

* * * * *